US011435083B2

(12) United States Patent
Cosic et al.

(10) Patent No.: US 11,435,083 B2
(45) Date of Patent: Sep. 6, 2022

(54) ASSEMBLY OF A GAS TURBINE WITH COMBUSTION CHAMBER AIR BYPASS

(71) Applicant: MAN Energy Solutions SE, Augsburg (DE)

(72) Inventors: Bernhard Cosic, Düsseldorf (DE); Franklin Genin, Baden (CH)

(73) Assignee: MAN ENERGY SOLUTIONS SE, Augsburg (DE)

( * ) Notice: Subject to any disclaimer, the term of this patent is extended or adjusted under 35 U.S.C. 154(b) by 0 days.

(21) Appl. No.: 17/351,903

(22) Filed: Jun. 18, 2021

(65) Prior Publication Data

US 2021/0396389 A1 Dec. 23, 2021

(30) Foreign Application Priority Data

Jun. 19, 2020 (DE) ..... 10 2020 116 245.6

(51) Int. Cl.

| | |
|---|---|
| ***F23R 3/14*** | (2006.01) |
| ***F23R 3/26*** | (2006.01) |
| ***F23R 3/28*** | (2006.01) |
| ***F23R 3/44*** | (2006.01) |

(52) U.S. Cl.

CPC ..... *F23R 3/286* (2013.01); *F23R 3/14* (2013.01); *F23R 3/26* (2013.01); *F23R 3/44* (2013.01)

(58) Field of Classification Search

CPC .... F23R 3/14; F23R 3/26; F23R 3/286; F23R 3/46

See application file for complete search history.

(56) References Cited

U.S. PATENT DOCUMENTS

| | | | | |
|---|---|---|---|---|
| 3,430,443 A | | 3/1969 | Richardson et al. | |
| 3,490,230 A | * | 1/1970 | Suter | F23R 3/26 60/39.23 |
| 4,353,205 A | * | 10/1982 | Cleary | F23R 3/10 60/39.23 |
| 4,363,208 A | | 12/1982 | Hoffman et al. | |

(Continued)

FOREIGN PATENT DOCUMENTS

| | | |
|---|---|---|
| DE | 1601531 | 12/1970 |
| DE | 60320344 T2 | 5/2009 |

(Continued)

OTHER PUBLICATIONS

Office Action dated Feb. 5, 2021 issued in German Patent Application No. 10 2020 116 245.6.

(Continued)

*Primary Examiner* — William H Rodriguez
(74) *Attorney, Agent, or Firm* — Cozen O'Connor

(57) ABSTRACT

An assembly for a gas turbine having a combustion chamber, a swirler, a combustion zone in the combustion chamber, and an air feed. In a transition region from the air feed to the swirler that is flowed through by the air, a plenum is formed and the assembly adjoining the plenum has the swirler, the combustion chamber, and a cover closing the combustion chamber. The assembly has an air conduction channel designed to conduct part of the air flow flowing into the assembly into the combustion chamber, so that the air flow leading through the air feed is divided into a main flow leading through the swirler into the combustion zone and a bypass flow leading past the combustion zone.

14 Claims, 1 Drawing Sheet

(56) References Cited

U.S. PATENT DOCUMENTS

| | | | | | |
|---|---|---|---|---|---|
| 5,351,477 | A | * | 10/1994 | Joshi | F23D 17/002 60/737 |
| 5,353,599 | A | * | 10/1994 | Johnson | F23M 5/085 60/39.83 |
| 2005/0016178 | A1 | | 1/2005 | Wasif et al. | |
| 2010/0319349 | A1 | | 12/2010 | Rajaram | |

FOREIGN PATENT DOCUMENTS

| | | |
|---|---|---|
| DE | 102009046066 | 5/2011 |
| FR | 2704305 | 10/1994 |

OTHER PUBLICATIONS

Search Report dated Oct. 26, 2021 issued in European Patent Application No. EP 21 18 0176.

* cited by examiner

ASSEMBLY OF A GAS TURBINE WITH COMBUSTION CHAMBER AIR BYPASS

BACKGROUND OF INVENTION

1. Field of the Invention

The invention relates to a gas turbine with combustion chamber air bypass.

2. Description of Related Art

A multiplicity of versions of gas turbines which, in part, also comprise a combustion chamber air bypass, is already known in the prior art.

Basically, a gas turbine is a machine for power generation or drive provision, in which a fuel or a mixture of air and fuel is combusted, in order to generate chemical power. The main components of the gas turbine substantially are the turbine, a compressor and a combustion chamber located in between.

For generating the mechanical power, air is compressed in the compressor, mixed with a fuel and the mixture fed to the actual combustion chamber, in which the mixture is ignited or combusted in a combustion zone. The hot gas generated during the combustion is expanded in the following turbine.

Depending on the temperature at which the combustion of the mixture in the combustion zone occurs or how hot the flame in the combustion zone burns, the emissions of the turbine change so that the same, dependent on the temperature of the combustion, emits different quantities of nitrogen oxides (NOx), carbon monoxides (CO) and further exhaust gas substances.

Since the emission values are legally regulated it is desirable to keep the combustion temperature and thus the combustion in a favourable range. During part-load operation of the gas turbine, in which the temperature of the combustion is disadvantageous and thus the combustion incomplete, a combustion chamber air bypass is often used for this purpose in the prior art, through which a part of the air flowing from the compressor into the combustion chamber is conducted past the combustion zone.

For this purpose it is provided with the known gas turbines that tubes penetrate towards the outside an outer pressure housing in which the air flowing from the compressor to the combustion chamber is conducted, and in another location lead, through the pressure housing and a combustion chamber wall delimiting the combustion chamber, into the combustion chamber.

However this has multiple disadvantages. Initially, high temperature gradients or expansions on the tube itself and on the components, which are connected by the tube, occurs because of different temperature or operating temperatures of the components, so that a compensator is needed in order to equalise the different expansions of the components. Added to this is that the lifespan of the combustion chamber or of the entire gas turbine is reduced since through the forced connection of the different components additional stresses are introduced into these. Combustion chamber air bypass systems designed in this manner are additionally very complex and expensive since besides the high temperatures these are also exposed to large pressure gradients.

SUMMARY OF THE INVENTION

One aspect of the invention is therefore based on the object of overcoming the aforementioned disadvantages and providing a gas turbine with combustion chamber air bypass, the costs of which, despite combustion chamber air bypass, are low and the lifespan of which is long despite combustion chamber air bypass.

According to one aspect of the invention, an assembly for a gas turbine or combustion chamber assembly for a gas turbine and according to a further aspect of the invention, a gas turbine having such an assembly, is proposed. The assembly comprises a combustion chamber, a swirler, which can also be referred to as swirl generator, a combustion zone arranged in an interior space of the combustion chamber and an air feed, wherein an air flow, flowing in in particular from a compressor flow-connected upstream to be fed to the combustion chamber via the air feed. In a transition region of the air feed to the swirler that can be flowed through by the air, a plenum is formed or provided, wherein the plenum can also be referred to as pre-chamber for the air flowing into the swirler or through the swirler into the combustion chamber. Furthermore, the assembly, adjoining the air space, the swirler and the combustion chamber, comprises a cover closing off the combustion chamber, which closes off the combustion chamber preferentially on one side or on both sides and can additionally lie against the swirler or form the same and delimit or close off the plenum on the front side. According to one aspect of the invention it is additionally provided that the assembly comprises an air conduction channel as combustion chamber air bypass, which is designed to guide a part of the air flow through the air feed into the assembly from the plenum through the cover and through the swirler past the combustion zone into the combustion chamber. Accordingly, the air flow conducted through the air feed is divided, preferentially in or during a part-load operation of the gas turbine, into a main flow leading through the swirler into the combustion zone and a bypass flow leading through the air conduction channel past the combustion zone. By way of an air conduction channel designed in this manner or the extension of the same from the plenum through the cover and the swirler into the combustion chamber, merely components are connected which, during the operation of the gas turbine, have a same or similar temperature, so that no temperature differentials occur on the air conduction channel or on components adjoining the same and accordingly neither high temperature nor pressure gradients occur, so that the operating point of the combustion chamber or of the combustion occurring in the combustion chamber is improved without complex measures such as providing a compensator have to be taken for this purpose.

Accordingly, an advantageous version provides that a temperature curve of a temperature of the air conduction channel and/or of a temperature adjoining the air conduction channel fluctuates or varies from an inflow side, on which the air flows into the air conduction channel, to an outflow side, on which the air flows out of the air conduction channel, by maximally 10%, preferentially maximally 5%, further preferentially by maximally 1%. Accordingly it can be provided that the air conduction channel only leads through components such as the cover, the swirler and the combustion chamber wall which during the operation have same or at least similar temperatures, which deviate from one another for example by maximally 10%. By way of the air conduction channel formed for example as tube at least in sections, only components are thus preferentially connected thermally and/or mechanically, which during the operation have a same or similar temperature and a same or similar material characteristic, so that temperature and/or expansion gradients on the air conduction channel or along the air conduction channels do not occur.

In order to be able to advantageously design the air conduction channel, a further development provides that the air conduction channel is formed by a tubing at least in sections.

Additionally or alternatively, the air conduction channel can be formed by the cover at least in sections, so that for example a section of the air conduction channel passing through the cover can be integrally formed by the cover.

In addition to this it can be provided that the air conduction channel is formed by the swirler at least in sections. As with the cover, the swirler or its material can integrally form the air conduction channel. When for example guide blades or other guide bodies are provided, through which the main flow flowing through the swirler is to be subjected to a swirl when flowing into the combustion chamber, these can be designed hollow at least in part, so that the bypass flow can flow through the guide bodies and the air of the bypass flow cannot enter the main flow or is conducted separately from the same. Alternatively, however, a tubing leading into or between the guide bodies and the bypass flow can also be easily provided.

Advantageous is in particular an embodiment, in which the air conduction channel leads from the plenum through the cover into an outer region, which is preferentially arranged on a side of the cover facing away from the combustion chamber. The air conduction channel is designed to redirect the bypass flow in the outer region on a side of the cover facing away from the combustion chamber. In addition, the air conduction channel leads from the outer region through the cover into the swirler, in which the bypass flow remains preferentially completely isolated from the main flow. From the swirler, the air conduction channel leads into a section of the combustion chamber, which is arranged in the flow direction of the main flow after and/or offset to the combustion zone, so that the air conducted through the bypass flow into the combustion chamber cannot flow into the combustion zone and accordingly is not involved in the combustion. The section of the air conduction channel leading through the outer region, which can be formed for example by a tube, is designed with respect to its length and its course so that from the exit from the cover to the entry into the cover it substantially maintains its temperature. Alternatively, the air conduction channel can also extend completely in the cover as a result of which the same becomes more complex and more expensive however.

In order to be able to adjust or control the air flow through the air conduction channel or a flow rate of the bypass flow and thus also a flow rate of the main flow, a further development additionally provides that in the air conduction channel a valve and preferentially a proportional valve is arranged. Further preferentially, such a valve is arranged along the section of the air conduction channel extending in the outer region and/or even in the outer region, as a result of which the valve can be easily mounted and maintained.

In order to thermally couple the cover and the swirler as well as preferentially the section of the air conduction channel passing through or formed by these, it is provided in a further version, that the cover and the swirler are integrally formed with one another or at least as one component.

To advantageously distribute and introduce the bypass flow in the combustion chamber, the air conduction channel additionally guides the bypass flow in an embodiment into an annular space formed in the combustion chamber, which annularly surrounds the combustion zone. Preferentially, the annular space adjoins a combustion chamber wall and is delimited by the same at least in sections. The position of the annular space, from which the air flowing in with the bypass flow can be annularly distributed and introduced into the sections of the combustion chamber adjoining the annular space, is thus preferentially shifted to the combustion zone in the radial direction and/or in the axial direction with respect to a rotational or centre axis of the combustion chamber.

When in a version multiple air conduction channels are provided, these can introduce the air along the respective bypass flow in spaces separated from one another into the combustion chamber. For example, multiple annular spaces can also be provided which in each case partly surround the combustion zone annularly or semi-annularly. When multiple air conduction channels are provided, these preferentially each follow the described course and have a valve for controlling the air flow rate.

To advantageously guide the air delivered through the bypass flow into the combustion chamber into the combustion chamber or into the combustion chamber in such a manner that the air does not flow into the combustion zone and is not involved in the combustion occurring there, at least one flow body provided on the annular space in a likewise advantageous version, which can be formed for example as inflow opening or nozzle. By way of the flow body, the bypass flow or the air flowing in through the bypass flow is introduced into a section of the combustion chamber located outside the annular space. Preferentially, multiple flow bodies are provided which are annularly arranged at even distances on or with the annular space, so that the bypass flow annularly flows in about the hot gases developing in the combustion zone, preferentially without negatively influencing the combustion in the combustion zone.

The air delivered into the combustion chamber by the bypass flow can then be delivered, jointly with the hot gases, which are generated through the combustion of the air delivered by the main flow into the combustion zone, out of the combustion chamber into the actual turbine.

Accordingly, a further advantageous version provides that the at least one flow body or the flow bodies is/are designed to introduce or inject the bypass flow into the section of the combustion chamber located outside the annular space such that the bypass flow in the combustion chamber does not pass through the combustion zone or to the combustion zone and thus a combustion occurring in the combustion zone of a mixture of a fuel and the air of the main flow is not influenced and preferentially not negatively influenced. In particular, the air of the bypass flow introduced through the at least one flow body is dragged along by the hot gases created during the combustion and conducted in the direction of the turbine.

Preferentially, the combustion chamber is a tubular combustion chamber, so that the combustion chamber is thus formed tubularly, which in the technical language is also referred to as "can type". Here, the cover with the swirler and also the combustion zone in the combustion chamber are preferentially provided at a front end or section of the tubular combustion chamber which faces away from the actual turbine.

Furthermore, the gas turbine or the assembly in an advantageous version comprises a pressure housing or outer pressure housing surrounding, spaced apart, the combustion chamber, wherein the air feed is formed by an air space between a combustion chamber wall delimiting the combustion chamber and the pressure housing annularly surrounding the combustion chamber wall. Accordingly, the air space preferentially also extends annularly about the combustion chamber.

The features disclosed above can be combined in any way for as long as this is technically possible and these do not contradict one another.

BRIEF DESCRIPTION OF THE DRAWINGS

Other advantageous further developments of the invention are characterized in the subclaims or are shown in more detail by way of the figures together with the description of the preferred embodiment of the invention. It shows:

DETAILED DESCRIPTION OF THE PRESENTLY PREFERRED EMBODIMENTS

The figures are exemplarily schematic. Same reference numbers in the figures point to same functional same and/or structural features.

Figure 1:
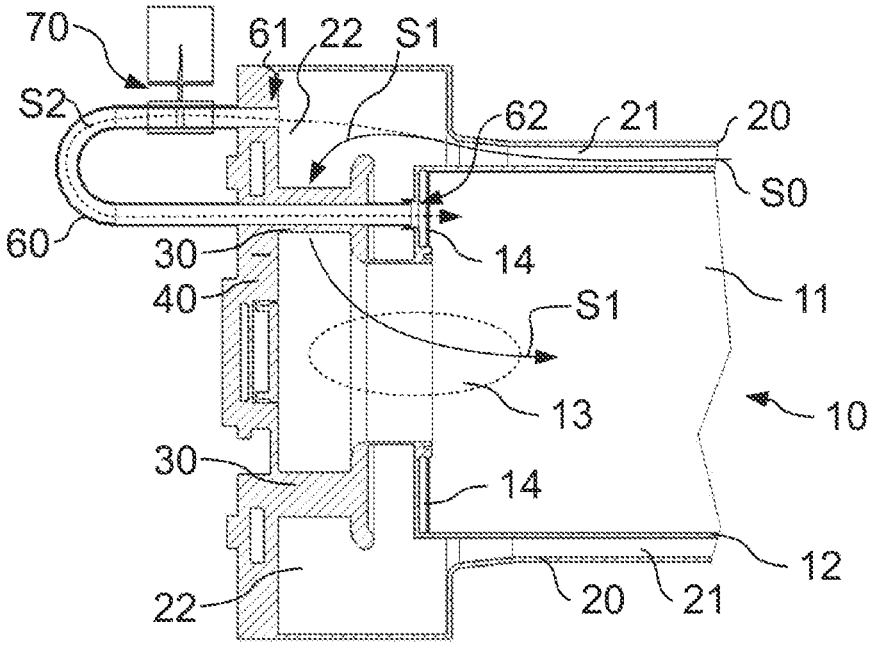
FIG. 1 is an extract of a combustion chamber with a pressure housing, swirler, and cover arranged thereon.

FIG. 1 shows a part of a gas turbine or of an assembly of a gas turbine and more precisely an extract of a combustion chamber 10 embodied as tubular combustion chamber, about which a pressure housing 20 is annularly arranged in the circumferential direction, and a swirler 30 arranged on the front side of the combustion chamber 10 and a cover 40 closing off the combustion chamber 10 on the front side. The assembly shown in FIG. 1 and consisting of the aforementioned components (actual combustion chamber 10, pressure housing 20, swirler 30, and cover 40) can also be referred to as combustion chamber in their entirety, wherein here the actual component, in which the combustion occurs, is referred to as combustion chamber 10.

Air compressed through a compressor flow-connected upstream flows along the air flow S0 through the air space 21, which is defined by the annular arrangement of the pressure housing 20 about the combustion chamber 10 or the distance between a combustion chamber wall 12, which surrounds the combustion chamber 10 in the circumferential direction about its centre axis and thereby delimits the combustion chamber 10 in the radial direction. Accordingly, the air space 21 itself is also formed annularly about the combustion chamber 10. The air flow S0 also flows annularly through the air space 21 from the compressor connected upstream to the pre-chamber of the swirler 30 in which the plenum 22 is formed, wherein in FIG. 1 only one possible flow path is exemplarily shown and designated. The fact that the shown flow path is merely exemplarily applies both to the air flow S0 flowing in from the compressor, which can also be referred to as basic flow, and also to a main flow S1 and a bypass flow S2 explained in the following.

The air flowing along the air flow S0 into the plenum 22 is divided, at least in a part-load operation of the gas turbine, into a main flow S1 and a bypass flow S0 through appropriate opening of the air conduction channel 60 by a valve 70. The air flowing along the main flow S1 flows through the swirler 30 and is swirled in the process or subjected to a swirl. The swirl-affected air out of the swirler 30 flowing or injected along the main flow S1 into the combustion chamber 10, which previously and preferentially was mixed in the swirler 30, and/or a space annularly surrounded by the swirler 30, and/or the cover 40 with a fuel, or the mixture of air and fuel created by way of this, is ignited or combusted in the combustion chamber 10, so that the combustion stabilises in the combustion zone 13 in the combustion chamber 10 and a flame burns in the combustion zone 13.

The working range of the flame and thus of the combustion in the combustion zone depends among other things on the ratio of the air and fuel fed in via the main flow S1. The mixture can also be referred to as air-fuel mixture.

When the combustion chamber 10 is operated too lean, the carbon monoxide emissions increase severely. This limits the operating range of the gas turbine in the part load range. In order to keep the emissions low and increase the working range of the combustion occurring in the combustion zone 13 or of the combustion chamber 10 it is possible to conduct the arriving air flowing in along the air flow S0 by opening or adjusting the valve 70 through the air conduction channel 60 along the bypass flow S1 past the combustion zone 13, so that less air is fed to the flame and thus carbon monoxide emissions avoided.

According to one aspect of the invention, it is provided in the gas turbine or the assembly shown by way of extract in FIG. 1 that a part of the air flowing in through the air space 21 into the plenum 22 of the swirler 30 is discharged through the cover 40 as a result of which the bypass flow S2 passing through the air conduction channel 60 is created. The air volume delivered along the bypass flow S2 or the quantity of air which is split off the air flowing in through the air space 21 is controlled by the valve 70 or a valve position of the valve 70.

The air flowing along the bypass flow S2 is conducted through the air conduction channel 60 here exemplarily formed tubularly, from the cover 40 to the valve 70 back to the cover 40 through the swirler 30 and into an annular space 14 downstream of the swirler 30.

Figure 2:
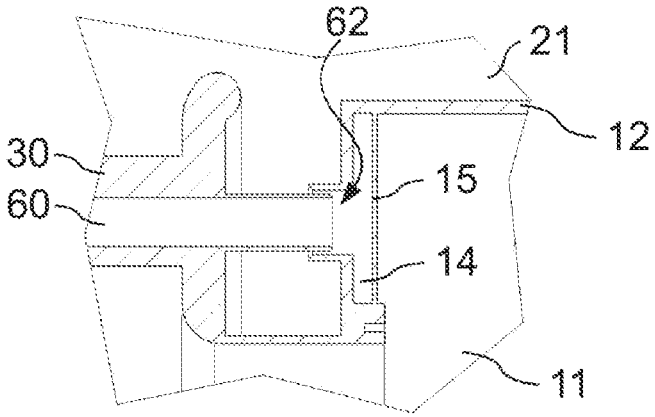
FIG. 2 is an extract of a pressure space formed in the combustion chamber.

The annular space 14 is shown by way of extract and enlarged in FIG. 2. The air delivered through the air conduction channel 60 into the annular space 14 is introduced or injected into the combustion chamber 10 via a or at least one flow body 15 so that the flame or the combustion in the combustion zone 13 is not negatively influenced. By way of this or by way of the course of the air conduction channel 60 from its inflow side 61 in or on the plenum 22 to its outflow side 62 in or on the annular space 14 through the cover 40 and the swirler 30 only components are interconnected which approximately have the same material temperature and which are interconnected even without a combustion chamber air bypass formed by the air conduction channel 60. By way of this, the disadvantages of most gas turbines with combustion chamber bypasses known in the prior art are avoided.

In its embodiment, according to one aspect of the invention, is not restricted to the preferred exemplary embodiments stated above. On the contrary, a number of versions is conceivable which made use of the shown solution even with fundamentally different types of embodiments.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An assembly for a gas turbine comprising:

a combustion chamber;

a swirler;

a cover;

a combustion zone arranged in an interior space of the combustion chamber;

an air feed, via which an air flow is fed to the combustion chamber;

a plenum is formed in a transition region that can be flowed through by air from the air feed to the swirler and an assembly adjoining the plenum comprises the swirler and the combustion chamber and the cover closing off the combustion chamber; and an air conduction channel configured as a combustion chamber air bypass, which conducts a part of the air flow flowing into the assembly through the air feed from the plenum through the cover and through the swirler past the combustion zone into the combustion chamber, so that air flow leading through the air feed is divided into a main flow leading through the swirler into the combustion zone and a bypass flow leading past the combustion zone.

2. The assembly according to claim 1, wherein a temperature curve of a temperature of the air conduction channel and/or of a temperature adjoining the air conduction channel varies from an inflow side, on which the air flows into the air conduction channel, to an outflow side, on which the air flows out of the air conduction channel, by maximally 10%.

3. The assembly according to claim 1, wherein the air conduction channel is formed by a tubing, at least in sections.

4. The assembly according to claim 1, wherein the air conduction channel is formed by the cover, at least in sections.

5. The assembly according to claim 1, wherein the air conduction channel is formed by the swirler, at least in sections.

6. An assembly for a gas turbine comprising:

a combustion chamber;

a swirler;

a cover;

a combustion zone arranged in an interior space of the combustion chamber;

an air feed, via which an air flow is fed to the combustion chamber;

a plenum is formed in a transition region that can be flowed through by air from the air feed to the swirler and an assembly adjoining the plenum comprises the swirler and the combustion chamber and the cover closing off the combustion chamber; and an air conduction channel configured as a combustion chamber air bypass, which conducts a part of the air flow flowing into the assembly through the air feed from the plenum through the cover and through the swirler past the combustion zone into the combustion chamber, so that air flow leading through the air feed is divided into a main flow leading through the swirler into the combustion zone and a bypass flow leading past the combustion zone, wherein the air conduction channel leads from the plenum through the cover into an outer region, the air conduction channel diverts a bypass flow in the outer region on a side of the cover facing away from the combustion chamber, and the air conduction channel leads from the outer region through the cover into the swirler and from the swirler into a section of the combustion chamber, which in a flow direction of the air flow is arranged after and/or offset to the combustion zone.

7. The assembly according to claim 1, further comprising:

a valve arranged in the air conduction channel, configured to adjust a flow rate of the bypass flow.

8. The assembly according to claim 1, wherein the cover and the swirler are formed integrally with one another.

9. The assembly according to claim 6, wherein the air conduction channel conducts the bypass flow into an annular space formed in the combustion chamber, which annular space surrounds the combustion zone.

10. The assembly according to claim 9, wherein at least one flow body is provided on the annular space, by way of which the bypass flow is conducted into a section of the combustion chamber located outside the annular space.

11. The assembly according to claim 10, wherein the at least one flow body introduces the bypass flow into a section of the combustion chamber located outside the annular space such that the bypass flow in the combustion chamber does not pass through the combustion zone and thus a combustion of a mixture of a fuel and air of the main flow occurring in the combustion zone is not influenced.

12. The assembly according to claim 1, wherein the combustion chamber is a tubular combustion chamber.

13. The assembly according to claim 1, further comprising:

a pressure housing surrounding the combustion chamber, wherein the air feed is formed by an air space between a combustion chamber wall delimiting the combustion chamber and the pressure housing annularly surrounding the combustion chamber wall.

14. A gas turbine comprising:

a combustion chamber;

a swirler;

a cover;

a combustion zone arranged in an interior space of the combustion chamber;

an air feed, via which an air flow is fed to the combustion chamber;

a plenum is formed in a transition region that can be flowed through by air from the air feed to the swirler and an assembly adjoining the plenum comprises the swirler and the combustion chamber and the cover closing off the combustion chamber; and an air conduction channel configured as a combustion chamber air bypass, which conducts a part of the air flow flowing into the assembly through the air feed from the plenum through the cover and through the swirler past the combustion zone into the combustion chamber, so that the air flow leading through the air feed is divided into a main flow leading through the swirler into the combustion zone and a bypass flow leading past the combustion zone.

* * * * *